US006299039B1

(12) United States Patent
Hsu

(10) Patent No.: US 6,299,039 B1
(45) Date of Patent: Oct. 9, 2001

(54) ARTICLE HANGER

(76) Inventor: Hung-Cheng Hsu, No. 7-3, Lane 140, Chang-Shui Road, Tsu-Tung Li, Changhua City (TW)

( * ) Notice: Subject to any disclaimer, the term of this patent is extended or adjusted under 35 U.S.C. 154(b) by 0 days.

(21) Appl. No.: 09/664,213

(22) Filed: Sep. 18, 2000

(51) Int. Cl.[7] ..... A41D 27/22
(52) U.S. Cl. ..... 223/87; 223/85
(58) Field of Search ..... 223/85, 87, DIG. 1, 223/88; 24/625, 618

(56) References Cited

U.S. PATENT DOCUMENTS 3,210,820 * 10/1965 Humiston ..... 24/625
4,063,669 * 12/1977 Smilow ..... 223/87
5,005,741 * 4/1991 Kolton et al. ..... 223/85
5,626,268 * 5/1997 Kolton et al. ..... 223/85
5,799,843 * 9/1998 Hsu ..... 223/85
5,857,597 * 1/1999 Kolton ..... 223/85

* cited by examiner

*Primary Examiner*—Bibhu Mohanty
(74) *Attorney, Agent, or Firm*—Harrison & Egbert

(57) ABSTRACT

An article hanger is formed of a hook, a marking plate extending from the hook, a fixed plate fastened at one to the marking plate and provided with a retaining hole, a flexible portion fastened at one end with other end of the fixed plate, and a movable plate fastened at one end to the other end of the flexible portion and provided at the other end thereof with a retaining projection having a slotted head. The movable plate is joined at the other end thereof with the fixed plate such that the slotted head of the retaining projection of the movable plate is detachably retained in the retaining hole of the fixed plate.

4 Claims, 8 Drawing Sheets

ARTICLE HANGER

BACKGROUND OF THE INVENTION

1. Field of the Invention

The present invention relates generally to a hanger, and more particularly to an article hanger.

2. Description of Related Art

As shown in FIGS. 1, 2, and 3, an article hanger 10 of the prior art has a hook 11, a marking plate 12 located under the hook 11, a fixed plate 13 extending downward from the marking plate 12, and a movable plate 14. Located at the junction of the fixed plate 13 and the movable plate 14 is a bending portion 15. The fixed plate 13 is provided with at least one retaining hole 17. The movable plate 14 is provided at the free end thereof with a retaining projection 16 which is shaped like a mushroom and has with a head 18.

In use, the article hanger 10 is held to the wall or ceiling by a retainer which catches the hook 11. The movable plate 14 is joined with the fixed plate 13 such that the head 18 of the retaining projection 16 is retained in the retaining hole 17 of the fixed plate 13, as shown in FIG. 3. Such a prior art article hanger 10 as described above is defective in design because the head 18 of the retaining projection 16 can not be easily pulled out of the retaining hole 17 once the head 18 is retained in the retaining hole 17. Such a structural deficiency of the prior art article hanger 10 as described above can be a source of annoyance.

BRIEF SUMMARY OF THE INVENTION

The primary objective of the present invention is to provide an article hanger free of the structural deficiency of the article hanger of the prior art described above.

The article hanger of the present invention is similar in construction to the prior art article hanger except that the head of the retaining projection of the movable plate of the article hanger of the present invention is provided with a plurality of slots. In other words, the retaining projection of the movable plate of the present invention has a slotted head which is provided with an elastic allowance enabling the head to be engaged or disengaged with the retaining hole of the fixed plate with ease and speed.

The foregoing objective, feature, and advantage of the present invention will be more readily understood upon a thoughtful deliberation of the following detailed description of the present invention with reference to the accompanying drawings.

BRIEF DESCRIPTION OF THE SEVERAL VIEWS OF THE DRAWINGS

FIG. 6-1 shows another schematic view of the article hanger of the present invention at work.

DETAILED DESCRIPTION OF THE INVENTION

Figure 5:
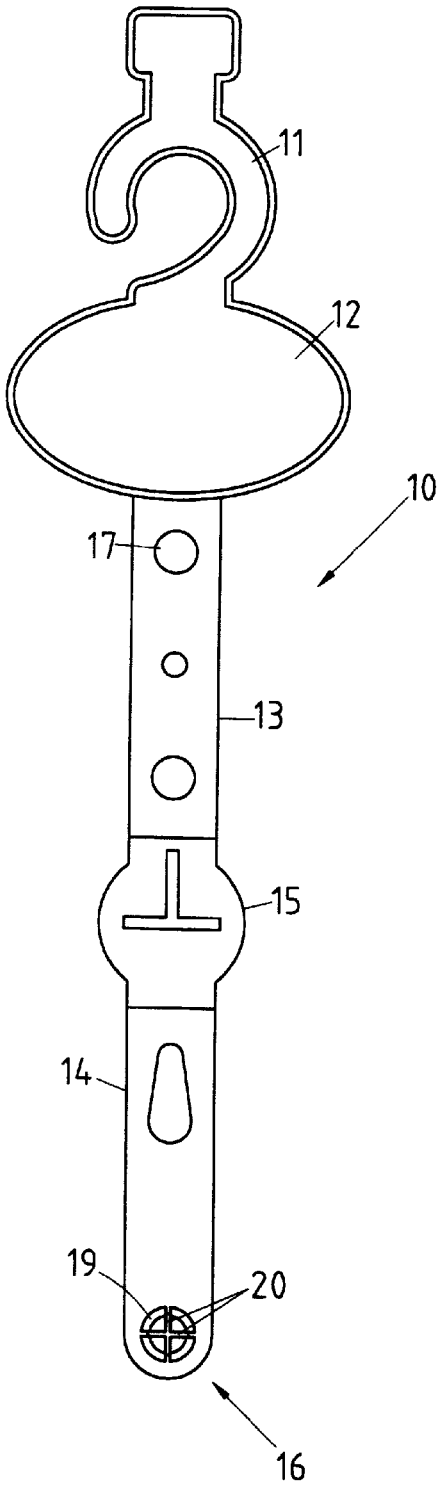
FIG. 5 shows a schematic plan view of the article of the present invention.

As shown in all drawings provided herewith, an article hanger 10 of the present invention comprises a hook 11, a marking plate 12 extending downward from the hook 11, a fixed plate 13 extending downward from the marking plate 12, and a movable plate 14 connected at one end with the fixed plate 13 by a flexible portion 15 and provided at the free end with a retaining projection 16. The fixed plate 13 is provided with a retaining hole 17 corresponding in location to the retaining projection 16. The retaining projection 16 has a head 19 which can be retained by the retaining hole 17 of the fixed plate 13. The head 19 is shaped like a mushroom cap. The head 19 may be spherical. The head 19 is provided with a plurality of slots 20. The head 19 may be provided with a cruciform slot 20, as shown in FIG. 5. In other words, the slotted head 19 is the feature of the present invention. The slotted head 19 of the present invention has an elastic allowance enabling the slotted head 19 to be put into or pulled out of the retaining hole 17 of the fixed plate 13 with ease and speed.

Figure 6:
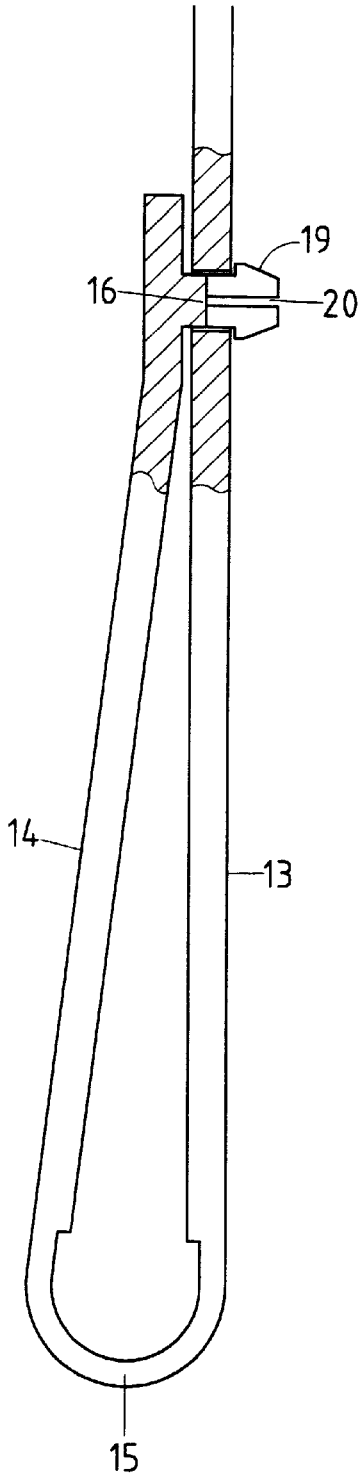
FIG. 6 shows a schematic view of the article hanger of the present invention at work.
Figures 1, 6:
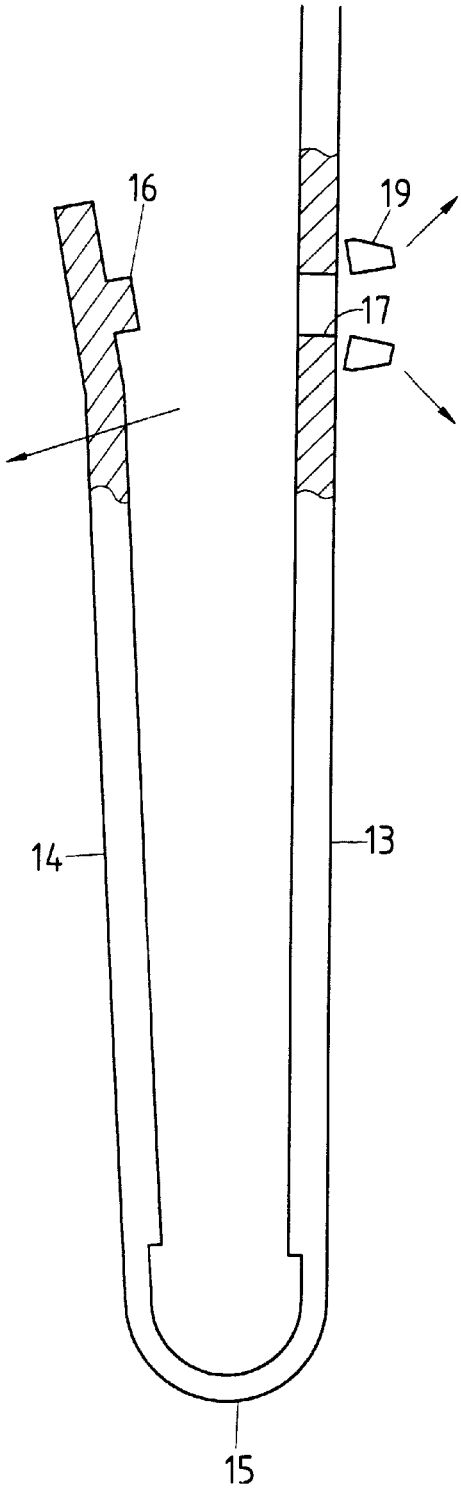
Figure 7:
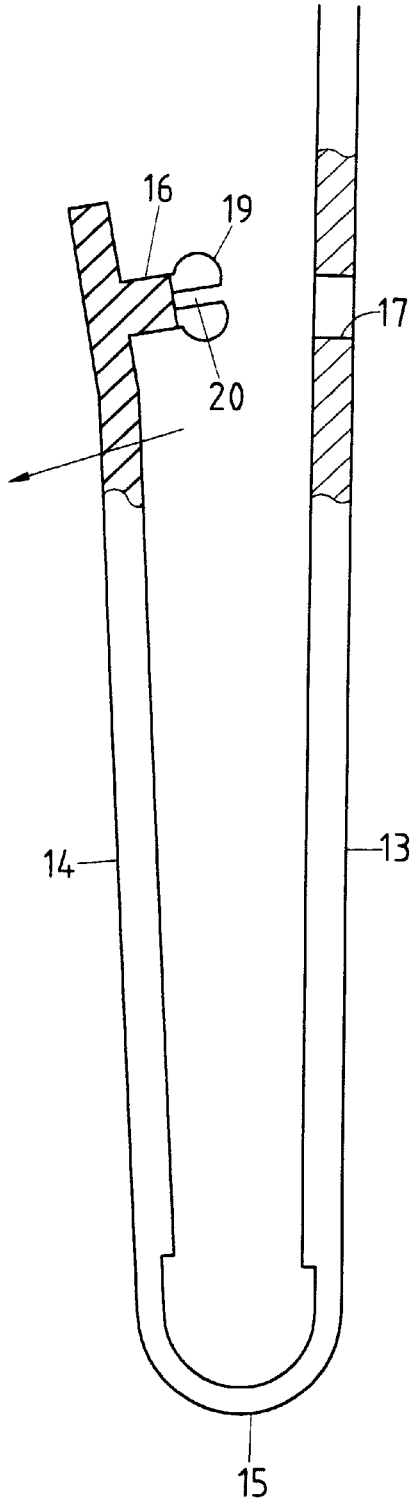
FIG. 7 shows a schematic view of another preferred embodiment of the present invention.

In use, the present invention is bent at the flexible portion 15 such that the movable plate 14 is joined with the fixed plate 13 for holding an article, and such that the slotted head 19 of the retaining projection 16 of the movable plate 14 is detachably retained in the retaining hole 17 of the fixed plate 13, as shown in FIGS. 6–7.

Figure 1:
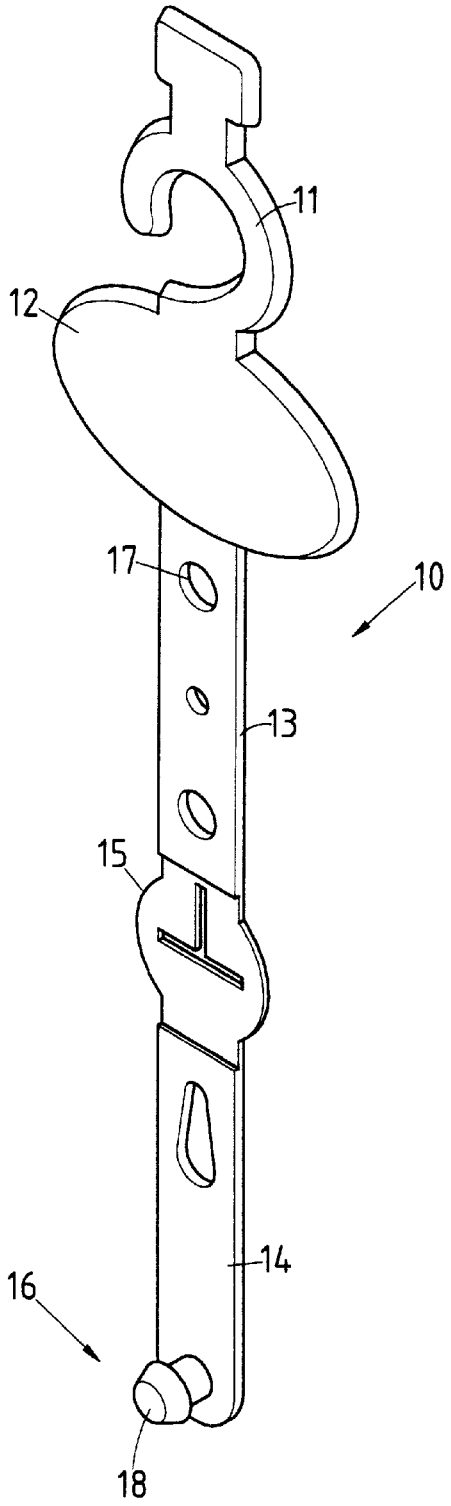
FIG.1 PRIOR ART
FIG. 1 shows a perspective view of an article hanger of the prior art.
Figure 2:
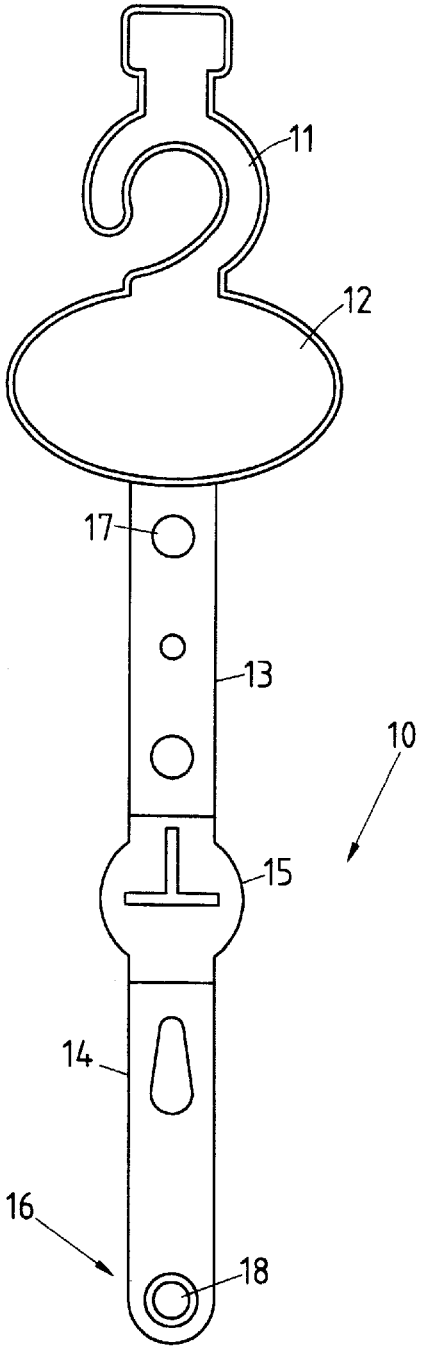
FIG.2 PRIOR ART
FIG. 2 shows a schematic plan view of the article hanger of the prior art.
Figure 3:
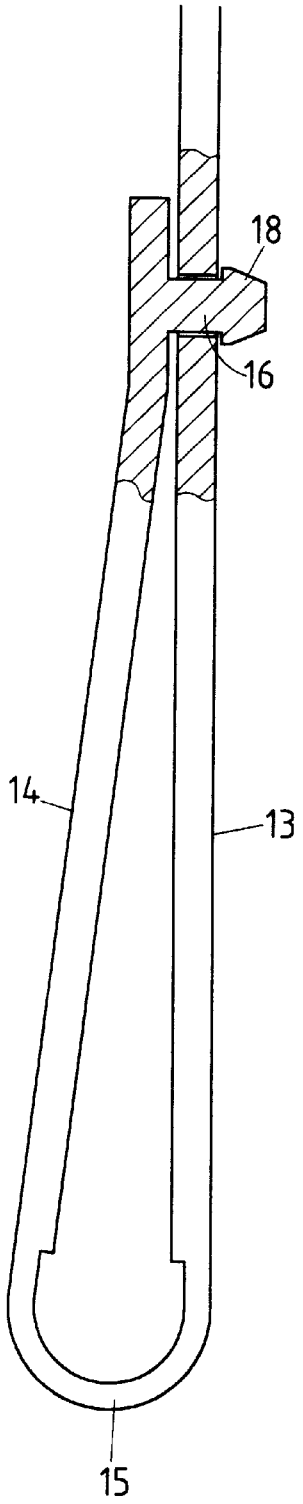
FIG.3 PRIOR ART
FIG. 3 shows a schematic view of the prior art article hanger at work.
Figure 4:
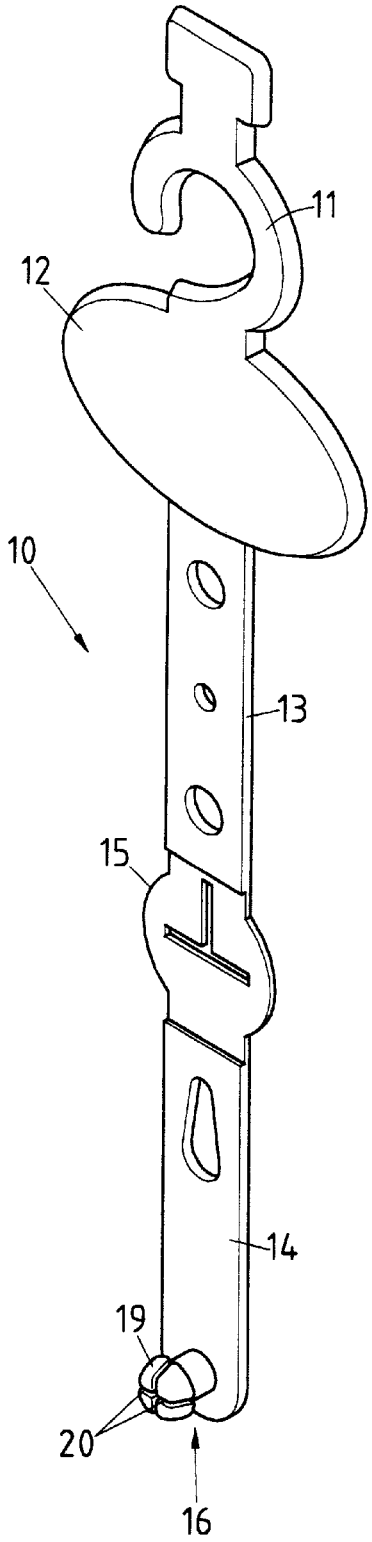
FIG. 4 shows a perspective view of an article hanger of the present invention.

In FIG. 6-1, the slotted head 19 is frangibly connected to the retaining projection 16. As such, when a pulling force is applied to the movable plate 14, the slotted head 19 will break away from the retaining projection 16. The movable plate will then separate from the fixed plate.

I claim:

1. An article hanger comprising:

a hook;

a marking plate extending from one end of said hook;

a fixed plate fastened at one end to said marking plate, said fixed plate having a retaining hole formed therein;

a flexible portion fastened at one end to an opposite end of said fixed plate;

a movable plate fastened at one end to an opposite end of said flexible portion; and a retaining projection affixed adjacent an opposite end of said movable plate, said retaining projection having a head frangibly affixed thereon, said head being detachably retained in said retaining hole of said fixed plate when said movable plate is joined to said fixed plate, said head separable from said retaining projection when said movable plate is pulled away from said fixed plate, said head being slotted.

2. The article hanger of claim 1, said head being slotted with a cruciform slot.

3. The article hanger of claim 1, said head having a mushroom cap shape.

4. The article hanger of claim 1, said head having a generally spherical shape.

* * * * *